US006899774B2

(12) United States Patent
Takayama et al.

(10) Patent No.: US 6,899,774 B2
(45) Date of Patent: May 31, 2005

(54) HIGH-TOUGHNESS WEAR-RESISTANT STEEL

(75) Inventors: Takemori Takayama, Hirakata (JP); Chikara Nakao, Hirakata (JP)

(73) Assignee: Komatsu Ltd. (JP)

( * ) Notice: Subject to any disclaimer, the term of this patent is extended or adjusted under 35 U.S.C. 154(b) by 0 days.

(21) Appl. No.: 10/188,054

(22) Filed: Jul. 3, 2002

(65) Prior Publication Data

US 2003/0026723 A1 Feb. 6, 2003

(30) Foreign Application Priority Data

Jul. 12, 2001 (JP) ..... 2001-212173

(51) Int. Cl.[7] ..... C22C 38/08; C22C 38/06

(52) U.S. Cl. ..... 148/336; 148/335; 148/330; 148/331; 148/320

(58) Field of Search ..... 148/330, 334, 148/336, 331, 320, 335; 420/119

(56) References Cited

U.S. PATENT DOCUMENTS 4,162,157 A * 7/1979 Parker et al. ..... 148/335

4,850,187 A * 7/1989 Siga et al. ..... 148/325

FOREIGN PATENT DOCUMENTS

JP 5-78781 3/1993

OTHER PUBLICATIONS

Peckner and Bernstein, Handbook of Stainless Steels McGraw–Hill Book Company, 1977, p. 14–15.*

* cited by examiner

*Primary Examiner*—Deborah Yee
(74) *Attorney, Agent, or Firm*—Rader, Fishman & Grauer PLLC

(57) ABSTRACT

A primary purpose is to provide an inexpensive high-toughness wear-resistant steel having satisfactory toughness where its hardness is HRC 55 or more. This steel contains at least 0.21 to 0.80 wt % C; 0.3 to 2.0 wt % Al; and 0.5 to 4.0 wt % Ni as essential components and further contains alloy elements such as Si, Mn, Cr, Mo, W, V, Ti, Cu and B; unavoidable impurities such as P, S, N and O; and the remainder which substantially consists of a tempered martensitic steel of Fe.

8 Claims, 4 Drawing Sheets

THE RELATIONSHIP BETWEEN HARDNESS (HRC) AND CHARPY VALUES

CARBURIZING AND QUENCHING HEAT TREATMENT CONDITION

HARDNESS DISTRIBUTIONS OF
CHARPY IMPACT TEST SPECIMENS

THE RELATIONSHIP BETWEEN
HARDNESS (HRC) AND CHARPY VALUES

HIGH-TOUGHNESS WEAR-RESISTANT STEEL

TECHNICAL FIELD

The present invention relates to high-toughness wear-resistant steel having high hardness as well as excellent toughness and applicable to excavating teeth for construction equipment (e.g., excavators and bulldozers) and to crawler belt links, rollers, bushings and sprockets for track-type vehicles. More particularly, the invention relates to high-toughness wear-resistant steel composed of tempered martensitic steel to which Al and Ni has been added in combination.

BACKGROUND ART

Examples of excavating teeth for use in construction equipment include ripper points, bucket teeth and cutting edges which work in rock and excavate the ground. Many parts such as crawler belt links, rollers, bushings and sprockets for track-type vehicles require high impact resistance and high wear resistance which are generally known to be inconsistent with each other.

As such wear-resistant steel, there have been widely used SNCM, SCrB and SMnB-base medium carbon steels which have undergone heat treatment such as quenching and tempering.

As disclosed in Japanese Patent Kokai Publication Gazette No. 5-78781 (1993), there is known a high-toughness, wear-resistant steel in which the grain boundary is reinforced by reducing the contents of P, S and Mn; grain boundary segregation is reduced by fining the crystal grains by the addition of Mo, V and Nb; and high temper softening resistance is attained by the combined addition of Mo, Cr, V and Nb.

In ordinary wear-resistant steels for use in construction equipment, toughness is generally obtained to a certain degree by adjusting hardness so as to fall within the range of from HRC 50 to 55. For ensuring such a characteristic range, SNCM, SCrB and SMnB-base medium carbon steels are commonly used. However, there have been strong demands to harder and tougher wear-resistant steel in view of cost reduction and the work environment for these machines which is getting severer in recent years.

The technique disclosed in Japanese Patent Kokai Publication Gazette No. 5-78781 tends to be costly, because the contents of P, S and Mn are reduced while expensive Mo is used in a large amount. In addition, this publication has revealed the disadvantage in its embodiment that toughness is obtained provided that high-temperature tempering up to secondary hardening temperature is carried out, so that hardness is not high enough and wear resistance is unsatisfactory.

The present invention is directed to overcoming the foregoing problems and a primary object of the invention is therefore to provide an economical high-toughness wear-resistant steel which ensures satisfactory toughness (Charpy impact value: 5 kgf-m/cm$^2$ or more) even when its hardness is HRC 55 or more.

DISCLOSURE OF THE INVENTION

After making tremendous research effort, the inventors have found that, for achieving the essential characteristics of the wear-resistant steel described above, it is effective to meet the following two conditions (1) and (2) and finally accomplished the invention by adding other conditions (3) to (7).

(1) Reinforcement of the grain boundary is made to be possible by combined addition of Al and Ni, thereby achieving dramatically improved toughness.

(2) The segregation of S within the crystal grain boundary is alleviated by appropriating the ratio between the concentrations of S and M in the steel, whereby the strength of the grain boundary is prevented from decreasing.

(3) Strong desulfurizing elements such as Zr, Ca, Y, La and Ce are added to restrain the segregation of S within the crystal grain boundary while the sulfite precipitate is granulated, which is effective for achieving improved toughness.

(4) Reduction of the contents of P and S enables alleviation of the grain boundary segregation and cleaning so that more improved toughness can be assured.

(5) By addition of one or more elements selected from the group consisting of V, Nb, Ti, Zr, Hf, Ta, Y, La and Ce (REM; rare earth metal), the fine carbide, nitride and sulfide particles of these elements are dispersed to promote production of fine crystal grains, whereby the grain boundary segregation and the stress concentration on the grain boundary are alleviated, leading to improved toughness.

(6) Even when alloy elements such as Mn, Cr, Mo, V and B are added in proper amounts to achieve stable hardenability, a significant degradation in toughness is not observed and heat processibility can be ensured for forming a sufficiently hardened layer in regions liable to wearing down.

(7) The amounts of alloy elements such as Mn, Cr, Mo, V and B are controlled to cause adequate temper softening resistance.

To sum up, a high-toughness wear-resistant steel according to the invention contains at least 0.21 to 0.80 wt % C; 0.3 to 2.0 wt % Al; and 0.5 to 4.0 wt % Ni as essential components and further contains alloy elements such as Si, Mn, Cr, Mo, W, V, Ti, Cu and B; unavoidable impurities such as P, S, N and O; and the remainder which substantially consists of a tempered martensitic steel of Fe.

Preferably, the steel of the invention contains, as the above alloy elements, at least one or more elements selected from the group consisting of 0.05 to 2.3 wt % Si; 0.5 to 3.0 wt % Mn; 0.5 to 2.0 wt % Cr; 0.1 to 1.2 wt % Mo; 0.4 wt % or less V; and 0.0003 to 0.003 wt % B.

Preferably, the weight percentage of S serving as an unavoidable impurity is controlled so as to be equal to or less than one hundredth of the weight percentage of Mn.

In addition, the steel of the invention contains one or more elements selected from the group consisting of Nb, Ti, Zr, Ta, Hf, Ca, Y, La and Ce in an amount of 0.005 to 0.2 wt % in total.

In the invention, the Charpy impact value when hardness is HRC 55 or more may exceed $-\frac{3}{5}$(HRC)+38.

Next, the reason why the respective amounts (wt %) of the components of the steel according to the invention are limited to the values described earlier will be explained in details.

C: 0.21 to 0.80 wt %

C is the element most contributable to the hardness of the martensite structure obtained after quenching which is intended for provision of wear resistance. This amount range for C is determined for the reason that if the amount of C is less than 0.21 wt %, the desired hardness (HRC 55 or more) cannot be attained whereas if it is equal to or more than 0.85 wt %, the hardness of the steel is substantially saturated, or the residual austenite phase is expanded accompanied with softening of the steel. Therefore, the amount of C is preferably within the range of from of 0.21 to 0.80 wt % and more preferably within the range of from 0.25 to 0.60 wt %.

Al: 0.3 to 2.0 wt %

Al is known to make a significant deoxidizing action and produce nitrogen and AlN in steel, contributing to fining of the crystal grains. Ordinary killed case hardening steels contain Al in amounts within the range of from 0.005 to 0.05 wt %. Al dissolved in a solid state within steel has a significant tendency to segregate in the grain boundary, and strongly expel the impurities P and S, which degrade the strength of the grain boundary, from the grain boundary while strongly attracting Ni (and Mo) which improves the toughness of the grain boundary. Therefore, in the invention, Al and Ni (and Mo) are positively added thereby achieving improved toughness. The addition of Al in an amount of less than 0.3 wt % is not enough to achieve satisfactory effect while the effect of Al is saturated when Al is added in an amount of 2.0 wt % or more. For this reason, the amount of Al to be added is preferably within the range of from 0.3 to 2.0 wt % and more preferably within the range of from 0.5 to 1.5 wt %.

Ni: 0.5 to 4.0 wt %

Since Ni increases hardenability as well as toughness, it is often added in amounts of 2.0 wt % or less like the cases of SNCM case hardening steel and AISI4340 high strength steel. In the invention, the lower limit of the amount of Ni is set to 0.5 wt %, because an improvement in toughness can be more effectively attained by combined addition of Ni and Al. The upper limit of the amount of Ni is set to 4.0 wt % on the ground that although the combined addition of Ni and Al accompanied by precipitation of NiAl intermetallic compounds improves temper softening resistance and wear resistance, the excessive addition of Ni not only spoils toughness far from bringing in a profit but also is economically disadvantageous. More preferably, the upper limit of the amount of Ni to be added is 3.0 wt %.

Si: 0.05 to 2.3 wt %

Si is unavoidably included in steel during steelmaking. Generally, Si is contained within the range of from 0.05 to 0.3 wt %. To enhance the temper softening resistance of steel, the amount of Si to be added is up to about 2.3 wt % like wear-resistant Cr—Mo—Si high strength steels (0.4C-2.3Si-1.3Mn-1.4Cr-0.35Mo-0.20V). In the invention, the addition of Si in amounts of up to 2.3 wt % is allowable. Examples of high strength steels are as follows:

NiCrMosi steel: 0.4C-1.5Si-0.75Mn-2.0Ni-1.0Cr-0.4Mo

NiMoSi steel: 0.25C-1.5Si-1.30Mn-1.80Ni-0.40Mo

CrMoSi (A) steel: 0.35C-1.50Si-1.25Mn-1.25Cr-0.35Mo-0.20V

CrMoSi (B) steel: 0.4C-2.3Si-1.3Mn-1.4Cr-0.35Mo-0.20V

In the invention, since Al, which stabilizes the ferrite phase of steel like Si, is contained as an essential element, Al is added in an amount which satisfies Al+Si<3.0 wt %, whereby a meaningless increase in quenching temperature is avoided.

Mn: 0.5 to 3.0 wt %

Mn is a useful element which not only makes a significant desulfurizing action but also improves the hardenability of steel. Like Ni, Mn significantly stabilizes the austenite phase of steel, decreasing A3 transformation temperature while decreasing quenching temperature. Mn is also useful in that it restricts a rise in A3 transformation temperature caused by the addition of Al and Si which are ferrite stabilizing elements. In the invention, the amount of Mn to be added is determined to be 3.0 wt % or less in consideration of the relationship represented by (Si+Al)=2.0(Ni+Mn) which approximates the influences of Mn, Ni, Si and Al upon eutectoid temperature, whereby quenching temperature is prevented from exceeding 900° C. and prior austenite grains are prevented from being coarsened exceeding ASTM grain size No. 8. It is apparent that the amount of Mn maintains the relationship described by S/Mn≦0.01 (described later).

Cr: 0.5 to 2.0 wt %

Cr is an element which improves the hardenability and temper softening resistance of steel. Addition of Cr in combination with Mo, Nb, V etc., considerably increases temper softening resistance. When the amount of Cr is 0.5 wt % or less, the effect of Cr is insufficient, whereas when it is 2.0 wt % or more, the economic effect of Cr cannot be expected.

Mo: 0.1 to 1.2 wt %

Mo is an element which increases the hardenability and temper softening resistance of steel and is also known as an element for restricting the high temperature temper embrittlement. In the invention, the lower limit of the amount of Mo is set to 0.1 wt % in view of the restriction of the high temperature temper embrittlement and the upper limit to 1.2 wt % or less in view of the restriction of the precipitation of carbide at quenching temperature.

V: 0.4 wt % or less

Although V is an element useful in increasing the temper softening resistance and wear resistance of steel, it is preferable to use V in an amount limited to 0.4 wt % or less because V carbide has low solid solubility and precipitates within the austenite phase when heated at quenching temperature, resulting in a decrease in toughness. A more preferable amount for V is 0.25 wt % or less.

B: 0.0003 to 0.003 wt %

B is an element which significantly improves hardenability and expected in many cases to have the economic effect of saving the amount of other alloy elements capable of increasing hardenability. Where the amount of B is less than 0.0003 wt % or less, the effect of B cannot be obtained, whereas where it exceeds 0.003 wt %, BN precipitates, causing a degradation in toughness. In addition, B is more likely to segregate in the austenite crystal grain boundary than P and S and above all, it expels S from the grain boundary, leading to an improvement in the strength of the grain boundary. Therefore, it is desirable to positively make use of B.

Nb, Ti, Zr: 0.005 to 0.20

Nb, Ti and Zr are well known as elements which make crystal grains fine and used in amounts within normal ranges. Where the amount of them exceeds 0.2 wt %, the amount of carbide and nitride precipitates increases, which is not good for toughness.

Apart from the elements described above, P and S may be added in the following amounts.

P: 0.015 wt % or less

P is not allowed to completely disappear by any heat treatments but remains, decreasing the strength of the grain boundary. However, the decrease in the strength of the grain boundary caused by the amount (0.015 wt %) of normally existing P can be substantially overcome by the addition of Al according to the invention.

S: 0.015 wt % or less

Like P, S is an element which is liable to surface segregation as well as grain boundary segregation and causes a decrease in the strength of the grain boundary. According to the invention, the amount of Mn which actively produces sulfide is controlled such that the ratio of S to M (wt %) of the steel is made to be 0.01 or less to allow the precipitation of Mns, thereby reducing the solid concentration of S in the steel matrix and reducing the grain boundary segregation to prevent a decrease in the strength of the grain boundary.

In addition, it is preferable to add rare earth elements such as Ca, Y, La and Ce, which actively produce sulfide, in amounts within the range of 0.2 wt % or less, whereby fine sulfide particles are uniformly dispersed in the steel and the solid concentration of S is reduced to restrict the grain boundary segregation. As a result, sufficient strength is ensured for the grain boundary. Apparently, a direct limitation of S content itself to 0.05% or less is more desirable.

BEST MODE FOR CARRYING OUT THE INVENTION

Next, reference is made to the drawings to concretely describe examples of the high-toughness, wear-resistant steel of the invention.

(First Embodiment: Carburizing TP Test)

Figure 1:
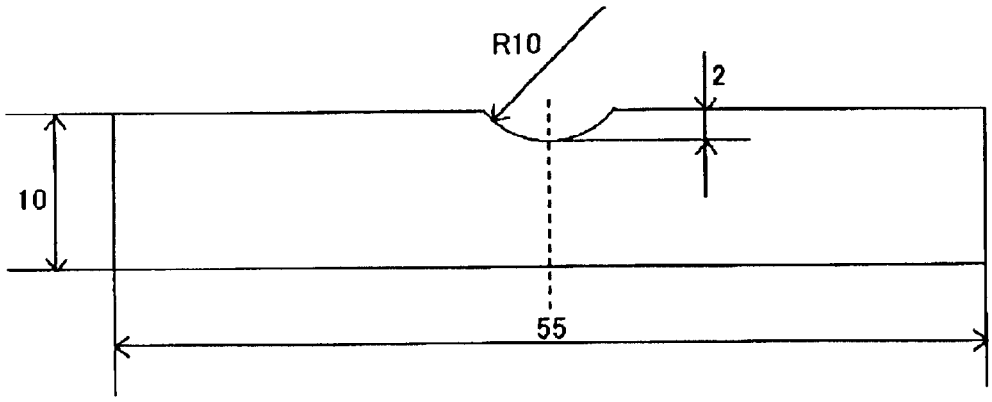
FIG. 1 diagrammatically shows a shape of a Charpy impact test specimen.

The steel compositions employed in this embodiment are shown in Table 1. Ingot steel was produced from each material in a high frequency melting furnace having a weight of 25 kg and shaped into a 35 mm diameter round bar by hot forging. Then, the rod was subjected to normalizing at 980° C. and machined to make a Charpy impact test specimen of the shape shown in FIG. 1.

TABLE 1

Steel material compositions and the results of Charpy impact tests

| No | C | Si | Mn | Ni | Cr | Mo | V | P | S | Al | B | Ti | surface hardness | Charpy values | S/Mn ratio |
|---|---|---|---|---|---|---|---|---|---|---|---|---|---|---|---|
| A | 0.2 | 0.07 | 0.5 | | 1.01 | 0.26 | | 0.006 | 0.003 | 1.07 | | 0.001 | 62.5 | 2.5 | 0.006 |
| *B | 0.19 | 0.07 | 1.19 | 1 | 1.01 | 0.25 | | 0.005 | 0.005 | 1.06 | | 0.008 | 62 | 7.6 | 0.004 |
| C | 0.22 | 0.22 | 0.82 | | 1.15 | 0.15 | | 0.007 | 0.005 | 0.033 | | | 63 | 1.9 | 0.006 |
| *D | 0.21 | 0.07 | 1.19 | 1 | 1.01 | 0.25 | | 0.013 | 0.01 | 1.06 | | | 62 | 5.9 | 0.008 |
| *E | 0.21 | 0.07 | 0.89 | 1.02 | 1.01 | 0.25 | | 0.005 | 0.006 | 0.29 | | | 62.5 | 4.6 | 0.007 |
| *F | 0.22 | 0.08 | 1.16 | 0.49 | 0.52 | 0.23 | | 0.006 | 0.005 | 0.73 | | | 62 | 4.9 | 0.004 |
| *G | 0.2 | 0.23 | 0.78 | 2.11 | 0.95 | 0.15 | | 0.015 | 0.014 | 1.53 | | | 61.5 | 5.7 | 0.018 |
| H | 0.21 | 0.23 | 0.76 | 1.97 | 0.92 | 0.16 | | 0.016 | 0.012 | 0.035 | | | 61.5 | 2.6 | 0.016 |
| I | 0.19 | 0.21 | 1.15 | 0.01 | 0.02 | | | 0.013 | 0.015 | 0.029 | | | 62.5 | 1.3 | 0.013 |
| *J | 0.2 | 0.24 | 1.61 | 0.53 | 0.03 | | | 0.015 | 0.011 | 0.32 | | | 61.5 | 4.2 | 0.007 |
| *K | 0.19 | 0.21 | 1.47 | 0.45 | 0.02 | | | 0.014 | 0.01 | 0.31 | 0.0013 | 0.09 | 61.5 | 4.9 | 0.007 |
| L | 0.18 | 0.22 | 1.45 | 0.01 | 0.01 | | | 0.013 | 0.009 | 0.029 | 0.001 | 0.07 | 61 | 3.2 | 0.006 |
| *M | 0.2 | 0.08 | 1.21 | 0.98 | 1.01 | 0.25 | 0.21 | 0.006 | 0.007 | 1.06 | | | 61.5 | 5.3 | 0.006 |
| N | 0.19 | 0.07 | 1.19 | 1.01 | 1.05 | 0.22 | 0.43 | 0.005 | 0.006 | 1.01 | | | 62 | 2.7 | 0.005 |

Figure 2:
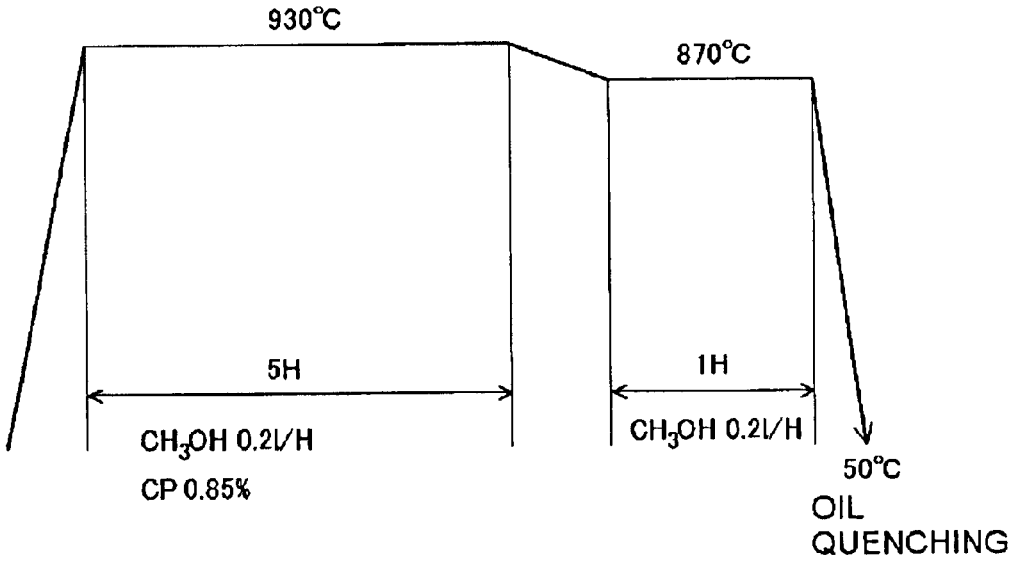
FIG. 2 is a graph showing a carburizing and quenching heat treatment condition adopted in a first embodiment.

As a heat treatment, carburizing and quenching was done within a small-sized carburizing furnace under the condition shown in FIG. 2 and then, tempering was carried out at 180° C. for three hours. While carbon potential was controlled to be 0.85% as shown in FIG. 2, it was found that the carbon concentrations of the surfaces of the Charpy test specimens after carburization ranged from 0.68 to 0.81 and a carburization depth of about 1 mm was obtained.

Figure 3:
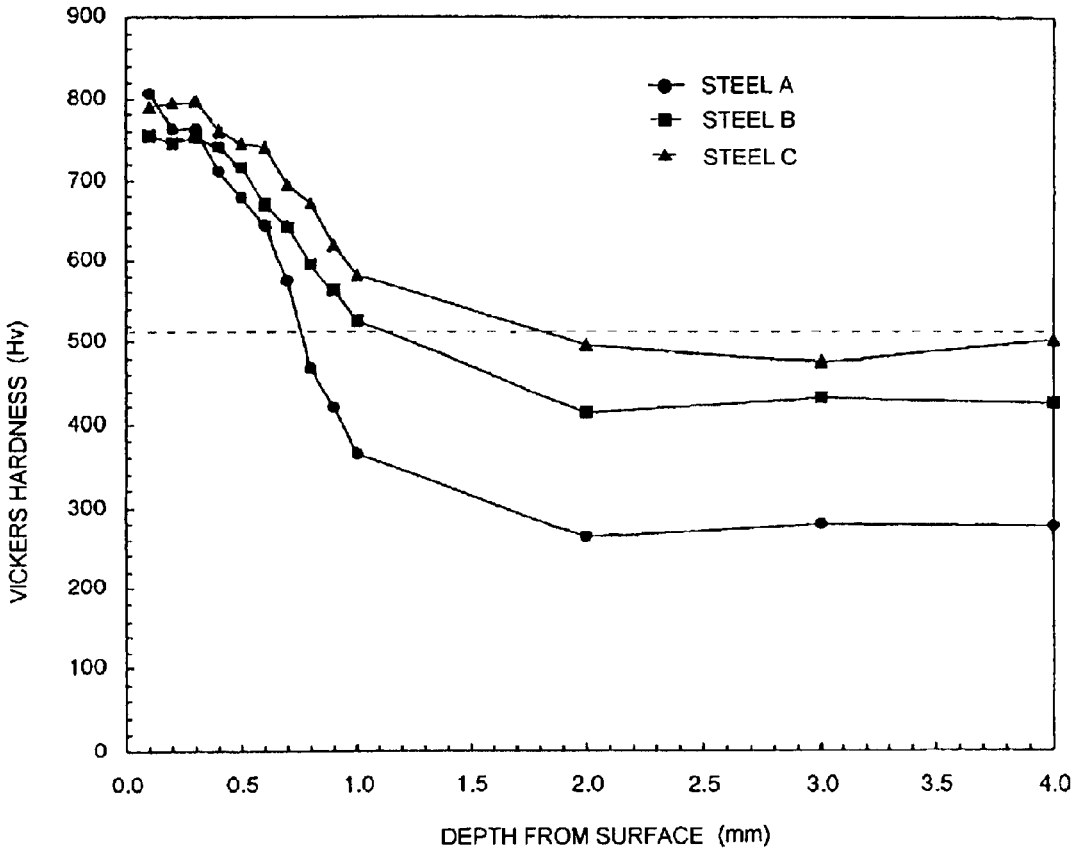
FIG. 3 is a graph showing the hardness distributions of Charpy impact test specimens according to the first embodiment.

As representative examples, the surface hardness distributions of specimens A, B and C (equivalent to SCM420) shown in Table 1 are demonstrated in FIG. 3. It was found that the surfaces of the specimens subjected to carburization in this embodiment had a Vickers hardness ranging from 700 to 800 (HRC 59 to 63).

In the Charpy test conducted on the above carburized specimens, measurements were made five times (N=5) for each steel. The average of the measurement values of each steel is also shown in Table 1 from which the following facts are understood. It should be noted that the steels B, D, E, F, G, J, K and M marked with * are prepared according to the invention and the steels A, C, H, I, L and N with no marks are comparative examples.

(1) It is found from the comparison among the specimens A, B, C, D, E, F, G and H that impact properties have been dramatically improved by the coexistence of Al and Ni and the toughness improving effect of the coexistence is observed in 3 wt % Al-0.5 wt % Ni.

(2) The effect of the coexistence of Al and Ni is also observed in the commercially available level steel containing P and S (the steel D).

(3) It is understood from the comparison between the steels J and E that even if large amounts of P and S are contained, improved toughness can be achieved by increasing the amount of Mn such that the S/Mn ratio is 0.01 or less.

(4) It is understood from the steel K and the steel L that toughness can be improved by adding B and more remarkably improved by the coexistence of Al and Ni in slight amounts.

(5) By comparing the steel M with the steel N, it is understood that where the amount of V is 0.43 wt % or more, a significant deterioration in toughness is caused by precipitation of V carbide.

(Second Embodiment: Medium Carbon Steel Test)

In this embodiment, the steels O to T having carbon contents ranging from 0.35 to 0.50 wt % and shown in Table 2 (the steel O and P are prepared according to the invention) were produced by ingotting, hot forging and normalizing, similarly to the fist embodiment. Then, Charpy impact test specimens having the shape shown in FIG. 1 were formed from these steels. As a quenching treatment, quenching was carried out at 870 to 930° C. for one hour and tempering was carried out at 450° C. for one hour. For the purpose of comparison, the same investigation was conducted on commercially available steels. Quenching temperature and tempering temperature for the commercially available steels were 850° C. and 200° C., respectively.

TABLE 2

Medium carbon steel compositions and the results of Charpy impact tests

| No | C | Si | Mn | Ni | Cr | Mo | V | P | S | Al | Nb | B | Ti | surface hardness | Charpy value |
|---|---|---|---|---|---|---|---|---|---|---|---|---|---|---|---|
| *O | 0.49 | 0.24 | 0.53 | 1.05 | 1.03 | 0.91 | 0.2 | 0.01 | 0.008 | 0.97 | 0.036 | | | 58 | 7.2 |
| *P | 0.48 | 1.52 | 1.34 | 1.01 | 1.51 | 0.51 | 0.13 | 0.009 | 0.008 | 1.03 | | | | 57.5 | 7.41 |
| Q | 0.44 | 0.27 | 0.41 | 0.04 | 0.97 | 0.96 | | 0.013 | 0.007 | 0.04 | 0.045 | 0.0015 | 0.0023 | 56.3 | 3.85 |
| R | 0.48 | 0.31 | 0.46 | 0.01 | 1.5 | 1.58 | 0.15 | 0.009 | 0.008 | 0.047 | 0.0051 | 0.002 | | 57 | 2.98 |
| S | 0.45 | 1.45 | 0.46 | 0.01 | 1.49 | 0.52 | 0.14 | 0.01 | 0.006 | 0.045 | 0.049 | 0.0018 | | 56.5 | 4.1 |
| T | 0.36 | 0.93 | 1.02 | 0.08 | 0.97 | 0.98 | 0.5 | 0.015 | 0.008 | 0.022 | | | 0.007 | 53 | 3.87 |
| SMnS435H | | | | | | | | | | | | | | 50 | 7.4 |
| SUJ2 | | | | | | | | | | | | | | 61 | 0.95 |
| SAE4161 | | | | | | | | | | | | | | 58 | 2.32 |
| SAE15B36 | | | | | | | | | | | | | | 48 | 6.7 |
| SCr435BH | | | | | | | | | | | | | | 51.5 | 4.6 |

Figure 4:
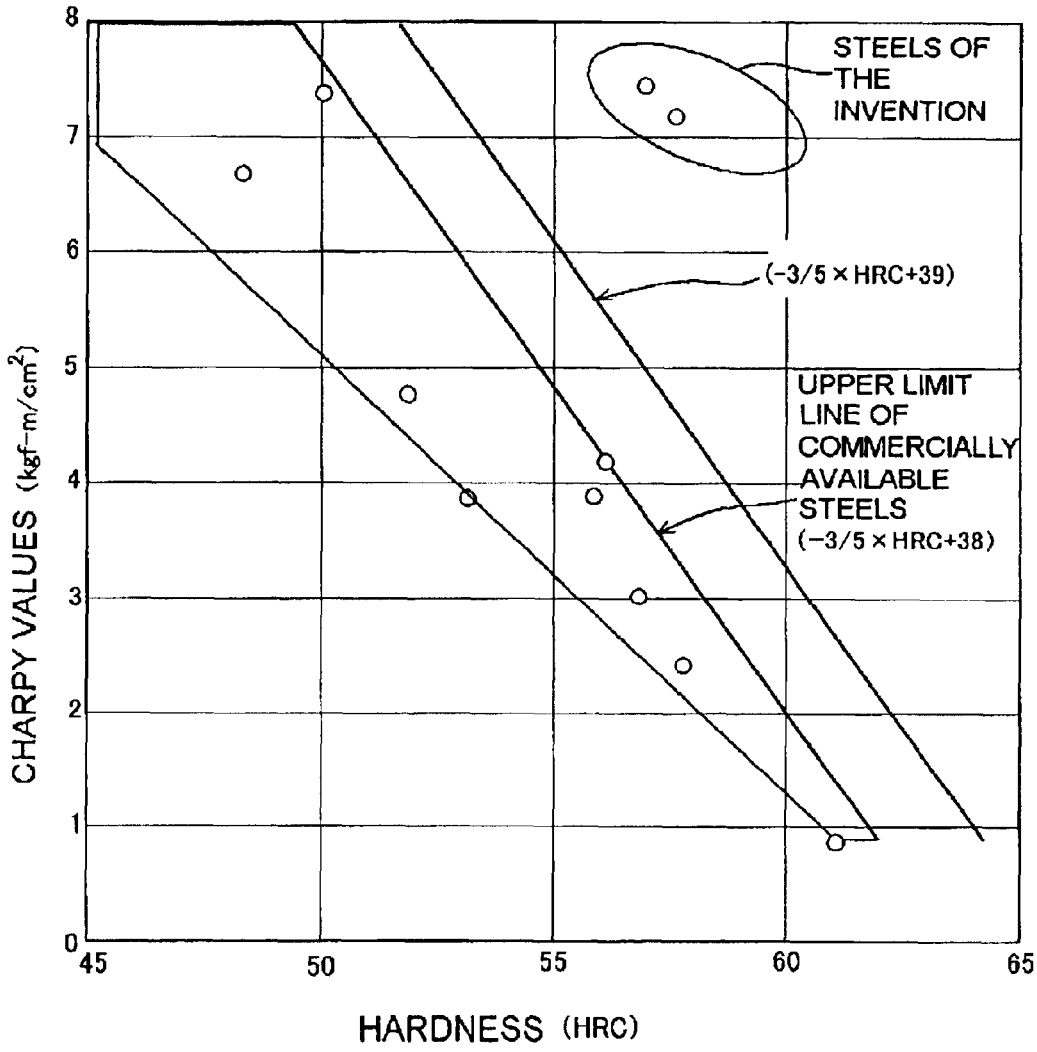
FIG. 4 is a graph of hardness verses Charpy impact values according to a second embodiment.

The measurement results of Charpy impact values are shown in TABLE 2 and FIG. 4. As apparent from these table and figure, the Charpy impact values of the steels prepared according to the invention are improved over those of the comparative steels and distributed in a zone higher than the upper limit line of the commercially available steels represented by:

Charpy impact value (kgf–m/cm$^2$)=$-\frac{3}{5}\times$HRC+38

What is claimed is:

1. A high-toughness wear-resistant tempered martensitic steel containing at least 0.21 to 0.80 wt % C; 0.3 to 2.0 wt % Al; and 0.5 to 4.0 wt % Ni as essential components and further containing 0.1 to 1.2 wt % Mo or 0.1 to 1.2 wt % Mo and 0.0003 to 0.003 wt % B, and other alloy elements such as Si, Mn, Cr, W, V, Ti and Cu; unavoidable impurities such as P, S, N and O; and the remainder which substantially consists of Fe.

2. The high-toughness wear-resistant tempered martensitic steel according to claim 1 containing, as said alloy elements, at least one or more elements selected from the group consisting of 0.05 to 2.3 wt % Si; 0.5 to 3.0 wt % Mn; 0.5 to 2.0 wt % Cr; and 0.4 wt % or less V.

3. The high-toughness wear-resistant tempered martensitic steel according to claim 1 or 2, wherein the weight percentage of S serving as one of said unavoidable impurities is controlled so as to be equal to or less than one hundredth of the weight percentage of Mn.

4. The high-toughness wear-resistant tempered martensitic steel according to claim 2 containing one or more elements selected from the group consisting of Nb, Ti, Zr, Ta, Hf, Ca, Y, La and Ce in an amount of 0.005 to 0.2 wt % in total.

5. The high-toughness wear-resistant tempered martensitic steel according to claim 1 or 2, wherein the Charpy impact value when hardness is HRC 55 or more exceeds $-\frac{3}{5}$(HRC)+38.

6. The high-toughness wear-resistant tempered martensitic steel according to claim 3, containing one or more elements selected from the group consisting of Nb, Ti, Zr, Ta, Hf, Ca, Y, La and Ce in an amount of 0.005 to 0.2 wt % in total.

7. The high-toughness wear-resistant tempered martensitic steel according to claim 3, wherein the Charpy impact value when hardness is HRC 55 or more exceeds $-\frac{3}{5}$(HRC)+38.

8. The high-toughness wear-resistant tempered martensitic steel according to claim 4, wherein the Charpy impact value when hardness is HRC 55 or more exceeds $-\frac{3}{5}$(HRC)+38.

* * * * *